US009212513B2

(12) United States Patent
Linnenkohl et al.

(10) Patent No.: US 9,212,513 B2
(45) Date of Patent: Dec. 15, 2015

(54) DRIVE DEVICE FOR EMBARKATION AND DISEMBARKATION DEVICES OF PUBLIC TRANSPORTATION VEHICLES

(75) Inventors: Lars Linnenkohl, Staufenberg (DE); Alfons Harding, Borchen (DE)

(73) Assignee: GEBR. BODE GMBH & CO. KG (DE)

( * ) Notice: Subject to any disclaimer, the term of this patent is extended or adjusted under 35 U.S.C. 154(b) by 0 days.

(21) Appl. No.: 14/353,103

(22) PCT Filed: Oct. 21, 2011

(86) PCT No.: PCT/EP2011/068417

§ 371 (c)(1),
(2), (4) Date: Sep. 25, 2014

(87) PCT Pub. No.: WO2013/056743

PCT Pub. Date: Apr. 25, 2013

(65) Prior Publication Data

US 2015/0027058 A1 Jan. 29, 2015

(51) Int. Cl.

| | |
|---|---|
| ***E05D 15/02*** | (2006.01) |
| ***E05F 15/12*** | (2006.01) |
| ***E05F 15/614*** | (2015.01) |

(52) U.S. Cl.

CPC ..... *E05F 15/12* (2013.01); *E05F 15/614* (2015.01); *E05Y 2400/44* (2013.01); *E05Y 2400/525* (2013.01); *E05Y 2900/51* (2013.01)

(58) Field of Classification Search

CPC ..... E05F 15/12; E05F 15/614
USPC ..... 49/42–47
See application file for complete search history.

(56) References Cited

U.S. PATENT DOCUMENTS

| | | | | |
|---|---|---|---|---|
| 5,647,173 | A * | 7/1997 | Stark et al. | 49/506 |
| 6,266,922 | B1 * | 7/2001 | Rockenbach | 49/42 |
| 6,367,198 | B1 * | 4/2002 | Rockenbach | 49/42 |
| 2006/0225351 | A1 * | 10/2006 | Wallerstorfer | 49/46 |

FOREIGN PATENT DOCUMENTS

| | | | |
|---|---|---|---|
| DE | 20316764 | U1 | 3/2005 |
| DE | 202008007585 | U1 | 4/2009 |
| DE | 202008001066 | U1 | 7/2009 |

(Continued)

OTHER PUBLICATIONS

International Search Report issued Aug. 2, 2012 re: PCT/EP2011/068417; citing: DE 20 2008 001066 U1, EP 1 738 993 A2, DE 20 2009 017683 U1, DE 20 2008 004592 U1 and WO 2006/002701 A1.

*Primary Examiner* — Jerry Redman
(74) *Attorney, Agent, or Firm* — Cantor Colburn LLP

(57) ABSTRACT

A drive device for embarkation and disembarkation devices of public transportation vehicles includes a drive unit arranged within and for driving a rotary column. The drive unit rotates the rotary column about the rotary column longitudinal axis Z-Z during opening and closing processes of the embarkation and disembarkation devices. The drive device is supported on the vehicle. The drive unit includes a drive motor, a non-self-locking reduction gear, and a controllable blocking component with which a rotation of the rotary column can be blocked. The drive device further includes a sensor for detecting the magnitude of an external force, wherein the force acts on the drive device. The drive device further includes an element for analyzing signals of the sensor and for triggering the blocking effect of the blocking component when an external force measured by the sensor exceeds a threshold.

10 Claims, 3 Drawing Sheets

(56) References Cited

FOREIGN PATENT DOCUMENTS

| | | | |
|---|---|---|---|
| DE | 202008004592 | U1 | 9/2009 |
| DE | 202009017683 | U1 | 5/2011 |
| EP | 1040979 | A2 | 10/2000 |
| EP | 1314626 | A1 | 5/2003 |
| EP | 1738993 | A2 | 1/2007 |
| WO | 2006002701 | A1 | 1/2006 |
| WO | 2009060085 | A1 | 5/2009 |
| WO | 2011067001 | A1 | 6/2011 |

* cited by examiner

DRIVE DEVICE FOR EMBARKATION AND DISEMBARKATION DEVICES OF PUBLIC TRANSPORTATION VEHICLES

FIELD

The disclosure pertains to a driving device for entering and exiting mechanisms of public transportation vehicles. The driving device comprises a drive unit that is arranged within a rotary column and drives this rotary column in that it rotates the rotary column about its longitudinal axis during opening and closing operations of the entering and exiting mechanisms.

BACKGROUND

Entering and exiting mechanisms on public transportation vehicles are known, in particular, in the form of passenger doors, entrance ramps, sliding steps or the like. Suitable driving devices are provided in order to move the respective entering and exiting mechanisms. These driving devices are frequently arranged in the region of the door frames or door portals above an opening and serve for opening and closing doors. Such doors in public transportation vehicles are typically realized in the form of swinging-sliding doors that also carry out a lateral displacement in addition to a swinging motion during opening and closing operations. Door systems of this type are known, for example, from EP 1 040 979 A2 and EP 1 314 626 A1. The driving devices for mere revolving or swinging doors that do not carry out a lateral displacement are usually also arranged above or underneath the doors in the region of the door portal. For example, DE 203 16 764 U1 describes the arrangement of a driving device in the upper region of a door portal.

It is furthermore known to realize driving devices of this type in a very compact fashion such that they can be integrated into the rotary column of a passenger door. Such a driving device is disclosed, for example, in DE 20 2008 007 585 U1. In addition to saving space, the accommodation of the drive unit directly in the rotary column provides numerous advantages with respect to the maintenance and installation of the entire driving device. Due to a special bearing arrangement, the driving device can furthermore remain largely unaffected by loads caused due to motions of the vehicle, the portal or the rotary column.

However, one frequent problem of such compact drive systems can be seen in that significant forces are exerted upon the drive unit and the gear via the lever arms of the door system when the door leaves are subjected to high forces in the open or closed state. Such high forces occur, in particular, during vandalism or opening and closing operations in overcrowded vehicles and can result in damages to the drive and/or the gear, in particular, if they are applied jerkily, e.g. on the door leaf.

In order to solve this problem, for example, WO 2011/067001 A1 proposes to provide a coupling device between the drive unit and a holding component, by means of which the driving device is arranged on the vehicle. Once a limiting value of the torque acting upon the drive unit is exceeded, the coupling device enables the drive unit to rotate about a vertical axis. This means that the entire drive unit also turns once a certain torque is exceeded such that damages to the driving motor and the gear are prevented. However, the coupling device only disengages when a certain limiting value is exceeded whereas the torques required for the normal operation can be transmitted without problems. In addition, a bearing is provided between the coupling device and the holding component and allows a wobbling motion of the rotary column with the coupling device in order to thusly compensate distortions and excursions of the rotary column due to motions of the vehicle.

In order to prevent doors from being manually opened, self-locking step-down gears may be utilized in order to block the doors. However, it has been proposed, for example in WO 2009/060085 A1, to forgo the utilization of a self-locking step-down gear such that the doors of the vehicle can be manually moved without blocking this motion due to the self-locking effect of the gear. A separate blocking device is provided such that the doors can still be prevented from being inadvertently opened. However, the blocking device can be controlled in order to open the doors in case of an emergency, i.e. the blocking effect of the blocking device can be canceled, if so required. Due to the low self-locking effect of the gear, the option of manually actuating the entering and exiting mechanisms is always ensured in case of an emergency, wherein it is merely required to cancel the blocking effect of the blocking device.

SUMMARY

Based on these circumstances, the disclosure aims to provide a driving device for entering and exiting mechanisms of public transportation vehicles, the drive unit of which is protected against damages due to excessively high external forces acting upon the entering and exiting mechanism. As such, there is a need for a driving device that should be constructed in the most robust, stable, and compact fashion possible.

The disclosed driving device for entering and exiting mechanisms of public transportation vehicles comprises a drive unit that is arranged within a rotary column and drives this rotary column in that it rotates the rotary column about its longitudinal axis Z-Z during opening and closing operations of the entering and exiting mechanism. In this case, the driving device is held on the vehicle and features a driving motor, a non-self-locking step-down gear and controllable blocking means. A rotation of the rotary column can be blocked with the blocking means.

According to the disclosure, the driving device features a sensor for measuring the magnitude of an external force acting upon the driving device. This external force is exerted by a person who intends to manually or even forcibly open the entering and exiting mechanism. In this case, the magnitude of this force can be measured directly or indirectly, for example, due to the deformation of a component by the external force. Consequently, the sensor does not necessarily have to measure the magnitude of the force itself, but may also register its effects, wherein the magnitude of the force can then be deduced from these effects.

The driving device furthermore features means for evaluating signals of the sensor and for canceling the blocking effect of the blocking means when a limiting value for an external force measured by the sensor is exceeded. This makes it possible to cancel the blocking effect of the driving device once a certain order of magnitude of the external forces is reached such that the respective entering and exiting mechanism can be manually opened without causing damages to the drive unit. In this case, the limiting value corresponds directly or indirectly to the magnitude of the externally exerted force. If the external force is measured based on the deformation of a component, for example, the limiting value corresponds to the degree of deformation and therefore only indirectly to the magnitude of the external force.

The driving device preferably comprises a torque bracket, by means of which the driving device is connected to the vehicle, wherein the torque bracket acts as a thrust bearing for a torque of the drive unit. In this way, a thrust bearing opposes the torque generated by the drive unit because the drive unit is fixed on a stationary component of the vehicle. It is therefore possible to transmit the driving torque of the driving device to the rotary column in order to realize a rotation thereof.

The sensor used comprises, for example, a strain gauge. Such a strain gauge can be easily bonded to a component of the driving device that deforms when high external forces are exerted upon the driving device. The strain gage registers this deformation and the blocking effect of the blocking means can be canceled once this deformation reaches a certain magnitude. The strain gage therefore measures the magnitude of an external force exerted upon the driving device indirectly based on the resulting deformation of a certain component. In this case, the limiting value for canceling the blocking effect of the blocking means only corresponds to the magnitude of an external force indirectly because the limiting value concerns to the degree of deformation.

In a preferred exemplary embodiment of the disclosure, the sensor in the form of a strain gauge is arranged on the torque bracket that acts as a thrust bearing for a torque of the drive unit. If a deformation of the torque bracket occurs at this location, the force acting upon the driving device is so high that it could cause damages to the drive unit.

In another exemplary embodiment of the disclosure, the sensor is connected to the blocking means via a control unit, wherein at least one limiting value for an external force measured by the sensor is stored in said control unit. In this case, the control unit features means for actuating the blocking means in such a way that the blocking effect of the blocking means is canceled when the at least one stored limiting value for an external force measured by the sensor is exceeded.

As a supplement, the driving device may furthermore feature means for actuating the driving motor when a limiting value for an external force measured by the sensor is exceeded, wherein the driving motor is actuated in a direction that opposes the direction of the external force. This makes it possible, for example, to prevent the entering and exiting mechanisms from completely opening because the motor moves these mechanisms against the external force.

In an exemplary embodiment of the disclosure, the limiting value for canceling the blocking effect of the blocking means differs from the limiting value for actuating the driving motor such that, for example, the motor is only activated at higher forces. However, the two limiting values may also be identical.

In a preferred exemplary embodiment of the disclosure, a bearing unit is provided between the drive unit and the torque bracket and allows a wobbling motion of the rotary column. In this way, distortions and excursions of the rotary column during the operation of the corresponding vehicle cannot negatively affect the drive unit. In this context, the term wobbling motion refers to an excursion in the X-direction and/or the Y-direction. In order to allow this wobbling motion, the bearing unit comprises, for example, a pivot bearing that is aligned with the rotary column. The torque bracket may furthermore also feature two pivot bearings, the pivoting axes of which are respectively situated at the same height or in the same horizontal plane. In this case, all three pivot bearings are positioned at a very high point of the rotary column such that the rotary column is already able to carry out a wobbling motion in the region, in which the rotary column is respectively fixed on the vehicle or on the portal.

This movable and flexible support of the driving device makes it possible to install the driving device in different vehicles. It would even be conceivable to utilize the driving device in a rotary column with a slight incline, for example, of no more than 5°.

Particularly in comparison with an embodiment that features a safety coupling of the type described in WO 2011/067001 A1, the disclosure has the advantage that significantly fewer components are required and that the disclosure can be realized with less effort. Furthermore, the driving device without safety coupling can be realized in a more compact fashion and is less maintenance-intensive. Furthermore, not the entire driving device rotates such that the disadvantages associated with persons or objects leaning against the rotary column in overcrowded vehicles are avoided. In addition, the limiting value for canceling the blocking effect can be individually adjusted for different vehicles or their operating conditions, respectively. For example, if it is determined during the operation of the vehicle that the limiting value was chosen excessively high or excessively low, it can also be easily changed by reprogramming a control unit.

Particularly the placement of a strain gauge on a torque bracket provides the advantage that the sensor can be easily arranged at this location and that it delivers reliable information on whether an external force could result in damages to the drive unit. If the torque bracket deforms despite the provided bearing arrangement, this indicates that the blocking effect should be canceled.

DETAILED DESCRIPTION OF THE DRAWINGS

Figure 1:
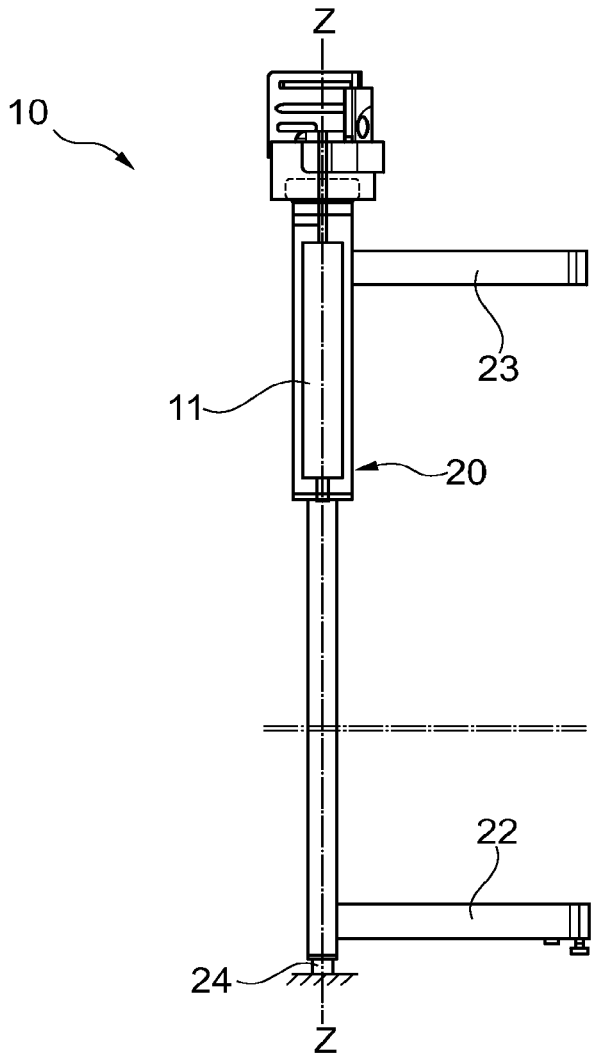
FIG. 1 shows a schematic diagram of a rotary column with integrated driving device.

FIG. 1 shows a simplified schematic diagram of a driving device for entering and exiting mechanisms of a vehicle. In this case, the corresponding drive unit 11 of the driving device 10 is accommodated within the outer tube of a rotary column 20 such that the driving device 10 comprises at least the rotary column 20 and the drive unit 11 accommodated therein. The rotary column 20 features holding arms 22 and 23 for mounting a not-shown door and is rotatably supported on the ground by means of a bottom bearing 24, wherein the ground is usually formed by the floor of the vehicle.

Figure 2:
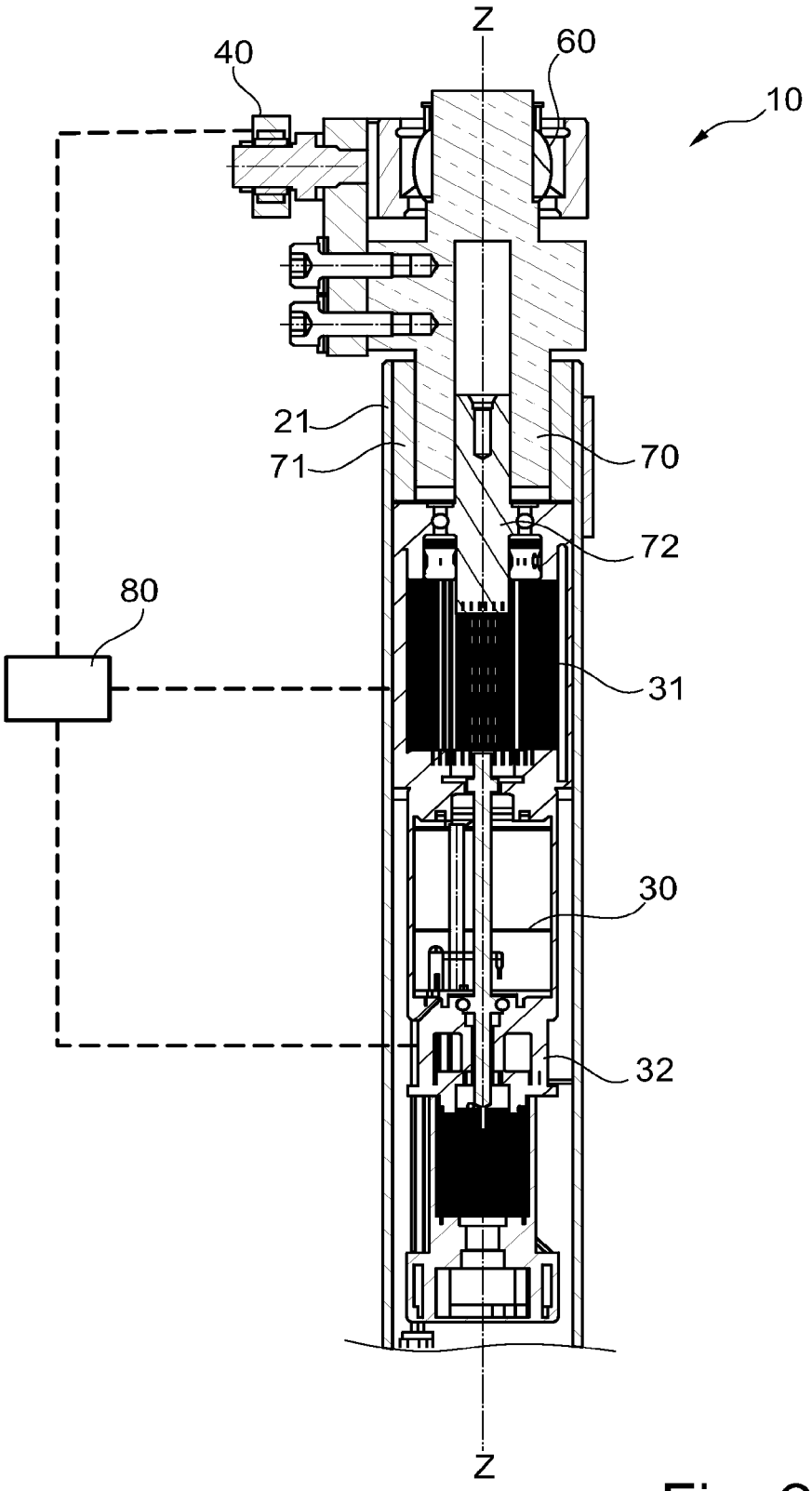
FIG. 2 shows a schematic axial section through part of an exemplary embodiment of the disclosed driving device.

The rotary column can be set in rotation about its longitudinal axis Z-Z (rotational axis Z-Z) by actuating the drive unit 11, wherein this causes a motion of the holding arms 22, 23 and the door mounted thereon. In this respect, the drive unit 11 may be designed differently or its components may be arranged differently within the rotary column. The design of a preferred exemplary embodiment of a disclosed driving device 10 is illustrated in FIG. 2, wherein this figure only shows the upper part of the rotary column 20 with the drive unit and the upper bearing arrangement.

This part of the rotary column 20 features an outer tube 21, in which a driving motor 30 and a step-down gear 31 are accommodated. An output element of the motor 30 is connected to an input element of the gear 31, the output shaft of which protrudes into a motor receptacle 70 in the form of a guide shaft 72. The guide shaft 72 is preferably noncircular in order to transmit the torque from the step-down gear 31 to the motor receptacle 70. For example, it may have a polygonal cross section. The motor receptacle 70 is rotatably supported in a bearing sleeve 71 that in turn is rigidly connected to the outer tube 21 of the rotary column 20. The guide shaft 72 may also be supported in the motor receptacle 70 such that it can be displaced in the Z-direction in order to allow a displacement of the drive unit in the Z-direction and to thusly compensate length changes due to compressions or elongations of the rotary column 20.

The entire disclosed driving device 10 is advantageously realized in the form of a compact drive, in which the electric driving motor 30 and the step-down gear 31 are arranged axially behind one another within the tubular housing 21 of the rotary column 20. This slender design of the drive makes it possible, e.g., to integrate the drive at any location of the tubular rotary door column in an optically appealing fashion. It is therefore easily possible to position the drive in dependence on the vehicle conditions and connecting options such that structural space for other components is created at the thus far conventional location for door drives, e.g. in the roof region.

Furthermore, the output element of the step-down gear 31 may be connected to a lifting-turning unit. This concerns a generally known component that is used, in particular, in external swinging doors. In this case, the vertical travel of the door produces a positive connection between the door leaf and the door portal by means of key collars.

The driving device 10 or the drive unit contained therein respectively is also provided with a bearing arrangement which takes into account that distortions and excursions of the rotary column can hardly be avoided during the operation due to the length of the rotary column. The motions of the rotary column 20 are caused, for example, by the corresponding vehicle being compressed and twisted due to the accelerations and decelerations, as well as when driving through curves. In buses, the contact of tires with curbstones or similar borders also causes a vehicle deformation and therefore a motion of the rotary column 20. Since the driving device 10 is fixed on a stationary component of the vehicle by means of the mounting, such distortions and excursions of the rotary column 20 can negatively affect the drive unit.

The driving device 10 is arranged on the vehicle by means of a holding component. To this end, the driving device preferably comprises a torque bracket 40, by means of which the driving device is fixed on the vehicle. The torque bracket 40 act as a thrust bearing for a torque of the drive unit and preferably features two pivot bearings 41 and 42. The drive unit is furthermore connected to the torque bracket 40 by means of another pivot bearing 60, wherein this bearing unit 60 allows a wobbling motion of the rotary column. In this case, the rotational axes of the three pivot bearings 41, 42 and 60 are preferably arranged at the same height or in the same plane such that a favorable force ratio is achieved.

According to the disclosure, it would furthermore be possible to realize a rotational measurement. This is advantageously achieved with an incremental value or absolute value encoder directly on the motor shaft of the driving motor 30 or an output shaft for the entering and exiting mechanism. For example, if the driving device 10 is used for a passenger door, the rotational measurement may be realized with the output shaft for a rotary column connection. The measurement of the rotation by means of the output shaft has the advantage that potential material failures within the drive can be detected and signaled when the door is inadvertently opened.

According to the disclosure, the step-down gear 31 of the drive unit is not realized in a self-locking fashion such that a manual actuation of the entering and exiting mechanism is always ensured in case of an emergency due to the slight self-locking effect. However, a blocking device 32 is provided such that the entering and exiting mechanism can still be blocked, wherein said blocking device may be realized, for example, in the form of a brake. In the exemplary embodiment illustrated in FIG. 2, this brake is situated axially underneath the motor 30. It is merely required to cancel the blocking effect of the blocking device 32 in order to open the door in case of an emergency. This results in a high degree of safety.

The additional blocking or braking device may be realized in such a way that it mechanically locks the drive in the currentless state. The brake can then be electrically and manually disengaged in order to decouple the drive and to thusly allow an electrical and/or manual operation. The manual disengaging of the brake may be realized by means of a conventional spring-loaded brake with manual release, wherein the manual release of the brake can be used as a mechanical emergency unlocking device. Brakes of this type are known as "low-active brakes." However, any other suitable blocking device may alternatively also be used. For example, the brake may act upon the output shaft of the driving motor 30 by means of a spring force and be released electromagnetically.

A blocking device in the form of a brake is not required if the driving motor 30 can be short-circuited. In this case, an entering and exiting mechanism can be held in a locked position and a motion, for example, of a door can be prevented due to the short-circuit torque of the driving motor 30. This function is always ensured, namely even if the vehicle is at a standstill and not in operation. In this case, the blocking means 32 according to the disclosure are not realized in the form of a separate unit, but rather in the form of means for short-circuiting the driving motor 30.

When the emergency unlocking function is actuated, the connection between the two contacts of the motor 30 is preferably interrupted by means of a mechanical switch such that the short-circuit torque is canceled and the door can easily be opened manually without problems. The self-locking effect of the door therefore is canceled by simply separating the negative or positive cable of the motor. The locking effect is always present in the currentless state of the motor, i.e. a power failure has no influence on this locking effect. If a power failure or electronics failure occurs, the emergency unlocking function can always be realized by actuating the short-circuit switch. The entering and exiting mechanism, particularly a door, can be once again locked after an interruption of the short-circuit by resetting the switch. In this case, the short-circuit switch preferably functions directly without auxiliary energy and therefore also while the vehicle is at a standstill or when a power failure occurs.

The advantages of utilizing such a short-circuit switch can on the one hand be seen in the reduction of the components required for the emergency unlocking function and the short-circuit switch can on the other hand be positioned at any ergonomically favorable location. The installation of otherwise required Bowden cables or pneumatic lines therefore is eliminated in this embodiment of the blocking means. Even a combination of a locking effect that is based on a short circuit and the utilization of a brake or mechanical lock would be conceivable. This may be the case, in particular, if the short-circuit torque does not suffice for securely locking the door.

The switchable short-circuit can be advantageously ensured with special windings of the motor windings that are exclusively provided for producing the short-circuit. Special windings also make it possible to achieve an improved braking effect or locking effect, respectively.

The chosen blocking means 32 therefore can be actively released if a person should be able to manually open the door. This is the case, for example, in an emergency. If external forces inadvertently act upon a door, for example, during vandalism or opening and closing operations in overcrowded vehicles, the blocking means would prevent the door from being opened. However, significant forces exerted upon the door leaves in the open or closed state cause the drive unit and the gear to be subjected to very high forces via the lever arms of the door system. These forces can result in damages to the drive or the gear.

According to the disclosure, the driving device 10 consequently comprises at least one sensor 50, by means of which such an external force acting upon the drive unit 11 can be directly or indirectly measured. As soon as the measured force exceeds a certain limiting value, the blocking effect of the chosen blocking means 32 is canceled such that the door can be opened. For example, the braking effect of a brake is canceled and/or the short-circuit torque of the motor 30 is canceled.

Figure 3:
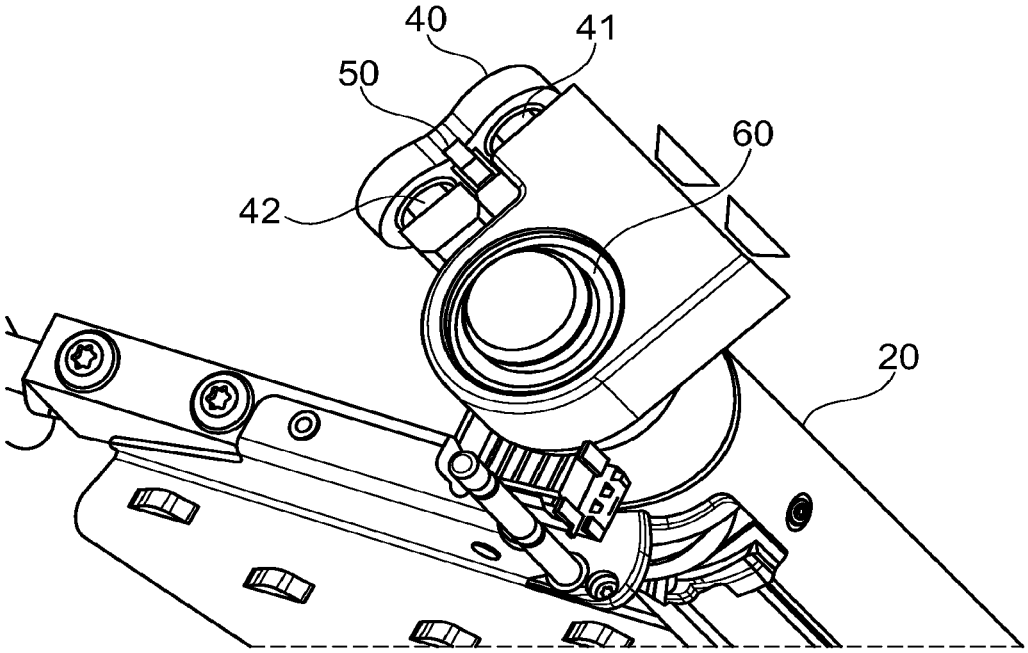
FIG. 3 shows a three-dimensional view of the upper part of a driving device.

The sensor 50 is preferably arranged on a torque bracket 40 of the type illustrated in the three-dimensional view according to FIG. 3. FIG. 3 also shows the upper pivot bearing 60 that allows a wobbling motion of the rotary column 20 and the two pivot bearings 41 and 22 of the torque bracket 40.

The sensor 50 is realized, for example, in the form of a strain gauge that is bonded to the torque bracket 40 at a suitable location with a special adhesive. A high external force that is exerted upon a door, for example, manually by a person causes the torque bracket 40 to deform and this deformation is registered by the strain gauge 50. As soon as the deformation reaches a certain limit, this is evaluated as an attempt to open the door and the blocking effect of the chosen blocking means 32 is canceled. The door therefore can be opened without damaging the drive unit.

However, the sensor 50 may also be arranged at a different location of the driving device 10 that is suitable for the measurement of an external force exerted upon an entering and exiting mechanism such as a door. It is also possible to utilize several sensors. In this respect, a sensor 50 does not have to be directly positioned at the location, at which such a force is exerted, but it may also be positioned at a location, at which an exerted force affects the driving device 10. The sensor 50 could also be arranged, for example, on the holding arms 22, 23 or the rotary column 20 and measure a deformation of these components. It would furthermore be possible to provide several sensors in order to register the effects of an externally applied force at different locations.

The limiting value for the measured external force may be stored in a control unit 80 and connected to the sensor 50 and the blocking means 32. This control unit 80 receives and evaluates the signals of the sensor 50. As soon as the stored limiting value is exceeded, the control unit 80 actuates the blocking means 32 accordingly. In this case, forces below the limiting value represent normal operating loads of the respective entering and exiting mechanism as they may occur, for example, when persons lean against doors. A door naturally should not open in such instances. Forces above the limiting value, in contrast, indicate an intentional attempt to open the door that could result in damages to the drive unit. In this case, the door should open so as to prevent damages. In order to distinguish between these two instances, the limiting value for canceling the blocking effect needs to be precisely determined. This may be realized, for example, based on experimental tests, in which the effects of different external forces on the driving device are measured. However, the limiting value may also be determined theoretically.

The blocking effect of the blocking means 32 therefore can be actively canceled when it is desired and therefore should be permitted to open an entering and exiting mechanism. However, it may also be passively canceled when, although not desired, it should be permitted to open an entering and exiting mechanism in order to prevent damages to the components of the drive unit.

As a supplement, the driving motor 30 may also be actuated when a limiting value of an external force acting upon the driving device 10 is exceeded. It is preferably actuated in a direction that opposes the external force. Although this makes it possible to partially open a door, the door is prevented from being completely opened by the motor. In this respect, the stored limiting values for canceling the blocking effect of the blocking means 32 and for actuating the driving motor 30 may be identical or differ from one another. When choosing different limiting values, the limiting value for canceling the blocking means 32 is preferably lower than the limiting value for actuating the motor 30. In this way, the motor is only activated at very high forces.

Under certain conditions, however, it would also be conceivable to actuate the motor 30 in the same direction as the external force. In this case, the door opens automatically in order to prevent further acts of vandalism. If the direction of the force cannot necessarily be deduced with the type and the arrangement of the sensor 50 on the driving device 10, additional information can be processed during the actuation of the motor 30. It may also occur, for example, that a person forcibly attempts to close an open door. If the chosen sensor 50 cannot register whether a person attempts to open or close a door, but rather merely registers that an external force is exerted, the control unit can provide information on the current state of the door. If the door is closed, this concerns an attempt to open the door whereas an open door may concern an attempt to forcibly close the door. The motor 30 can then be accordingly actuated in the same or the opposite direction.

If a strain gauge is suitably arranged on a torque bracket 40, however, it is also possible to register deformations of the torque bracket 40 in different directions. This makes it possible to deduce the direction of the exerted force. It is also possible to arrange several strain gauges in order to better determine the direction of the exerted force.

In one exemplary embodiment of the disclosure, an alarm is furthermore triggered when the limiting value for an external force is exceeded. This alarm signal can be transmitted to the driver of the vehicle and/or a central office.

The invention claimed is:

1. A driving device for entering and exiting mechanisms of a public transportation vehicle, comprising a drive unit arranged within a rotary column and drives this rotary column by rotating the rotary column about a longitudinal axis Z-Z during opening and closing operations of the entering and exiting mechanisms, wherein the driving device is held on the vehicle and the drive unit features a driving motor, a non-self-locking step-down gear and controllable blocking means configured to block a rotation of the rotary column, wherein the driving device comprises a sensor configured to measure a magnitude of an external force acting upon the driving device, wherein the driving device furthermore features means for evaluating a plurality of signals of the sensor and canceling a blocking effect of the blocking means when a limiting value of an external force measured by the sensor is exceeded.

2. The device according to claim 1, wherein the driving device further includes a torque bracket that connects the driving device to the vehicle, wherein the torque bracket acts as a counter bearing configured for opposing a drive unit torque.

3. The device according to claim 2, wherein the sensor is arranged on the torque bracket.

4. The device according to claim 2, wherein the torque bracket features two pivot bearings.

5. The device according to claim 1, wherein the sensor consists of a strain gauge.

6. The device according to claim 1, wherein the sensor is connected to the blocking means through a control unit, wherein at least one limiting value for an external force measured by the sensor is stored in the control unit, and in that the control unit features means for actuating the blocking means to cancel the blocking effect of the blocking means when the at least one limiting value is exceeded.

7. The device according to claim 1, wherein the driving device features means for actuating the driving motor when a limiting value for an external force measured by the sensor is exceeded, wherein the driving motor can be actuated in a direction that opposes the direction of the external force.

8. The device according to claim 7, wherein the limiting value for canceling the blocking effect of the blocking means differs from the limiting value for actuating the driving motor.

9. The device according to claim 1, wherein a bearing unit is provided between the drive unit and the torque bracket and allows a wobbling motion of the rotary column in at least one direction orthogonal to the longitudinal axis.

10. The device according to claim 9, wherein the bearing unit further includes a pivot bearing aligned with the rotary column.

* * * * *